US008025325B1

(12) United States Patent
Carrier et al.

(10) Patent No.: US 8,025,325 B1
(45) Date of Patent: Sep. 27, 2011

(54) ALL TERRAIN RETRIEVAL VEHICLE FOR MEDICAL EMERGENCIES

(76) Inventors: Brian E. Carrier, Eldred, PA (US); Anthony Wiles, Salley, SC (US)

( * ) Notice: Subject to any disclaimer, the term of this patent is extended or adjusted under 35 U.S.C. 154(b) by 872 days.

(21) Appl. No.: 10/324,630

(22) Filed: Dec. 20, 2002

Related U.S. Application Data

(63) Continuation of application No. 09/565,347, filed on May 5, 2000, now abandoned.

(60) Provisional application No. 60/133,177, filed on May 7, 1999.

(51) Int. Cl.
*A61G 3/00* (2006.01)

(52) U.S. Cl. ..... 296/19; 296/190.08

(58) Field of Classification Search ..... 296/19, 296/102, 190.08
See application file for complete search history.

(56) References Cited

U.S. PATENT DOCUMENTS

| | | | | | |
|---|---|---|---|---|---|
| 1,567,876 | A | * | 12/1925 | Turner | 296/156 |
| 2,805,887 | A | * | 9/1957 | Selby | 296/102 |
| 2,966,223 | A | * | 12/1960 | Gleasman | 180/20 |
| 3,035,654 | A | * | 5/1962 | Nuttall, Jr. et al. | 180/14.4 |
| 3,155,185 | A | * | 11/1964 | Allen et al. | 180/223 |
| 3,435,798 | A | * | 4/1969 | Rieli | 440/12.66 |
| 3,765,357 | A | * | 10/1973 | Peri | 114/67 A |
| 3,771,615 | A | * | 11/1973 | Rieli | 180/6.48 |
| 4,060,261 | A | * | 11/1977 | Bauer et al. | 280/756 |
| 4,570,741 | A | * | 2/1986 | McCoy | 180/242 |
| 4,821,825 | A | * | 4/1989 | Somerton-Rayner | 180/22 |
| 4,940,280 | A | * | 7/1990 | Templeton | 296/190.03 |
| 4,946,193 | A | * | 8/1990 | Oka | 280/769 |
| 4,973,082 | A | * | 11/1990 | Kincheloe | 280/756 |
| 5,012,880 | A | * | 5/1991 | Abner | 180/89.11 |
| 5,174,622 | A | * | 12/1992 | Gutta | 296/77.1 |
| 5,400,734 | A | * | 3/1995 | Doyon | 440/12.51 |
| 5,509,710 | A | * | 4/1996 | Eavenson et al. | 296/19 |
| 5,573,300 | A | * | 11/1996 | Simmons | 296/193.04 |
| 5,702,142 | A | * | 12/1997 | Newell | 296/19 |
| 5,993,273 | A | * | 11/1999 | Adams | 440/5 |
| 6,029,750 | A | * | 2/2000 | Carrier | 169/52 |
| 6,254,159 | B1 | * | 7/2001 | Wieczorek et al. | 296/19 |
| 6,695,566 | B2 | * | 2/2004 | Rodriguez Navio | 414/538 |
| 6,798,343 | B2 | * | 9/2004 | Carrier et al. | 340/539.13 |

* cited by examiner

*Primary Examiner* — James Keenan
(74) *Attorney, Agent, or Firm* — Jon L. Woodard; Robert M. Bauer; MacDonald, Illig, Jones & Britton LLP

(57) ABSTRACT

A vehicle for fighting fires, retrieving hazardous materials, performing rescues and providing emergency medical services in remote areas comprises an all terrain vehicle suitably equipped for the task it is intended to carry out. As a vehicle for retrieving hazardous materials, it is equipped with a crane (202) to lift a container (204) of waste onto its deck (206). For emergency medical services and searches and rescues, it has a full length protective wire mesh (252) over driver and occupants and a stretcher (254) elevated on cabinetry (258) so that the stretcher extends over the seat back to fit within the confines of the mesh.

7 Claims, 6 Drawing Sheets

ALL TERRAIN RETRIEVAL VEHICLE FOR MEDICAL EMERGENCIES

CROSS-REFERENCE TO RELATED APPLICATIONS

This application is a continuation of prior U.S. application Ser. No. 09/565,347 filed on May 5, 2000 now abandoned of the same title. U.S. application Ser. No. 09/565,347 claims the benefit under 35 U.S.C. §119 (e) of provisional application Ser. No. 60/133,177 filed May 7, 1999. The entire contents of these prior applications are expressly incorporated herein by reference.

STATEMENT REGARDING FEDERALLY SPONSORED RESEARCH OR DEVELOPMENT

Not applicable.

REFERENCE TO A MICROFICHE APPENDIX

Not applicable

FIELD OF INVENTION

The present invention relates to vehicles for retrieving items from remote areas. More specifically, the present invention is a vehicle equipped to perform rescues, provide emergency medical services and retrieve dangerous or hazardous cargo in remote areas or areas not accessible to full-size vehicles or by paved roads.

BACKGROUND OF THE INVENTION

Although the system of paved roads in many places throughout the world is excellent, there are still many areas that are remote or where the lack of paved roads makes access difficult. In these remote areas, events may take place or circumstances exist that require retrieval of people or cargo.

So-called "all terrain vehicles" are designed to travel over uneven surfaces and rough ground, usually for those engaged in hunting or fishing to get to areas where these sports can be enjoyed. These vehicles are well suited to travel where needed. However, they are not always equipped for accomplishing tasks other than to carry people and cargo for recreational uses.

For example, not all fires that threaten life and property occur in urban areas where roads lead to a convenient spot for deploying fire-fighting equipment and tapping into a municipal water supply. Fires often occur in remote, rugged areas where water for dousing the fire might be in short supply. To make matters worse, because many of these areas are covered with vegetation and trees, there will be no shortage of fuel for the fire. Consequently, some of the most destructive fires—forest fires and brush fires—occur or begin in remote areas.

These fires are fought in a variety of ways, usually by attempting to remove fuel from the fire's path with earth-moving equipment or by dousing the fire with water or fire retardant carried by transport planes or helicopters. Establishing a fire break takes time; sometimes the fire must be extinguished or at least controlled until a fire break can be established. Under these circumstances, fires are fought by individuals on foot carrying tanks of water on their backs. Water, of course, cools the fuel below its ignition temperature. By adding a foaming agent to the water, the resulting foam suffocates the fire and makes better use of the water. However, it may require a large number of tanks and many trips on foot over rugged ground to secure control over a fire. There remains a need for a more effective way to control fires in remote areas.

In addition, many public safety departments, including fire and police departments, conduct search and rescue operations in areas that are not suitable for automotive traffic, or they provide emergency medical service to those far from a paved road. In such instances, it may not be possible to transport medical equipment or rescue equipment to specific locations by ambulance because of the terrain. In the past, the equipment had to be carried to the injured individual by the search and rescue personnel, who then had to carry the injured party back out. Consequently, there is a need for a more effective way to transport equipment and personnel over areas having rough terrain and for transporting injured persons.

Still another example is in removing dangerous or hazardous cargo from remote areas. Sometimes hazardous wastes are found in remote areas, areas where those wastes were dumped years before. Often the ground near such wastes is soft, muddy or overgrown with vegetation. Recovery of the drummed waste can be difficult. Large-scale construction equipment such as crawler tractor cranes can be brought to such a location to remove the wastes, however, in some cases, this kind of equipment may do more harm than good because of size and relative lack of maneuverability.

SUMMARY OF THE INVENTION

According to its major aspects, the present invention is an all terrain vehicle equipped to rescue or help injured people or to recover hazardous cargo. The vehicle is outfitted to provide the equipment needed for each task while affording protection for the driver and other passengers.

The emergency medical and rescue all terrain vehicles both have a back deck that is enclosed in metal mesh, as is the cab. A stretcher and backboard are attached to the vehicle running from front to back, with the front, where the rescued person's head would be, nearest the driver. The items stocked on board the vehicle depend on the intended use. For example, when used as a rescue vehicle, the present invention will carry ropes and chains among other items; when used as an EMS vehicle, it will include a jump kit and oxygen, among other items.

When used to retrieve hazardous wastes, the present vehicle will include a small crane to lift a drum of waste onto its back deck.

The combination of an all terrain vehicle and a stretcher with a protective enclosure is an important feature of the present invention. Presently, the only way to evacuate an injured or potentially injured individual is with a helicopter. However, the use of a helicopter is expensive and may not be convenient. Furthermore, helicopters are dependent on weather conditions and may not be usable to recover injured individuals from a heavily wooded area when there is a forest fire. The enclosure prevents further injury to the recovered person. Having the all terrain vehicle equipped with rescue equipment or emergency medical equipment (or both) allows the driver to perform a rescue once the individual is found and stabilize the recovered individual's physical condition immediately.

The combination of an all terrain vehicle and a small crane adapted to lift a barrel containing hazardous waste onto the vehicle's deck is another important feature of the present invention. A 55 gallon drum will weigh 500-600 pounds if full. A crane engineered for this weight can lift such a container out of an overgrown, muddy or swampy area to the deck of an all terrain vehicle which can then move it to an area where the recovered drum can be overpacked or processed in another suitable way.

Another feature of the present invention is the use of a storage cabinet to elevate the stretcher so that one end of it can extend over the back of the seat of the all terrain vehicle. This arrangement not only allows the full length of the stretcher to fit into the vehicle but also makes good use of the space beneath the stretcher and allows the driver to keep the person on the stretcher in view since the head end of the stretcher will be adjacent to the driver.

Providing pulleys on the roof of the all terrain vehicle and a winch on the front of it permits better use of the vehicle for rescue and retrieval operations because the winch cable can be run over these pulleys so that the vehicle can pull from the rear as well as from the front and can pull in a somewhat more upward direction when needed rather than in a horizontal direction.

Other features and their advantages will be apparent to those skilled in fire-fighting equipment from a careful reading of the Detailed Description of Preferred Embodiments accompanied by the following Drawings.

DETAILED DESCRIPTION OF PREFERRED EMBODIMENTS

The present invention is a vehicle equipped and designed for various purposes in remote areas. Depending on the embodiment to be described, the vehicle is designed to cover rough terrain to recover hazardous materials, to rescue people, and to provide emergency medical service.

Referring now to FIGS. 1-6, there is shown a vehicle 200 according to a preferred embodiment of the present invention. Vehicle 200 is the type that is generally referred to as an "all terrain vehicle." Specifically, it is designed to be drivable on uneven ground, on mud, through deep water, or on other surfaces a regular automobile or truck cannot be driven on. To achieve this effect, the vehicle is relatively lightweight, may have six- or eight-wheel drive, is sealed against water intrusion to critical engine and transmission parts, and is chain driven and geared for low speeds and power. Weight reduction is achieved by using a polyethylene body. The tires are formed to provide traction on slippery ground and to paddle the vehicle forward on water. Alternatively, the vehicle may move using tank treads made of synthetic or natural rubber, as shown. Suitable basic all terrain vehicles are manufactured by Recreative Industries, Inc. and sold under the trademark BUFFALO, and by Argo, Inc. and sold under the trademark VANGUARD.

Figure 1:
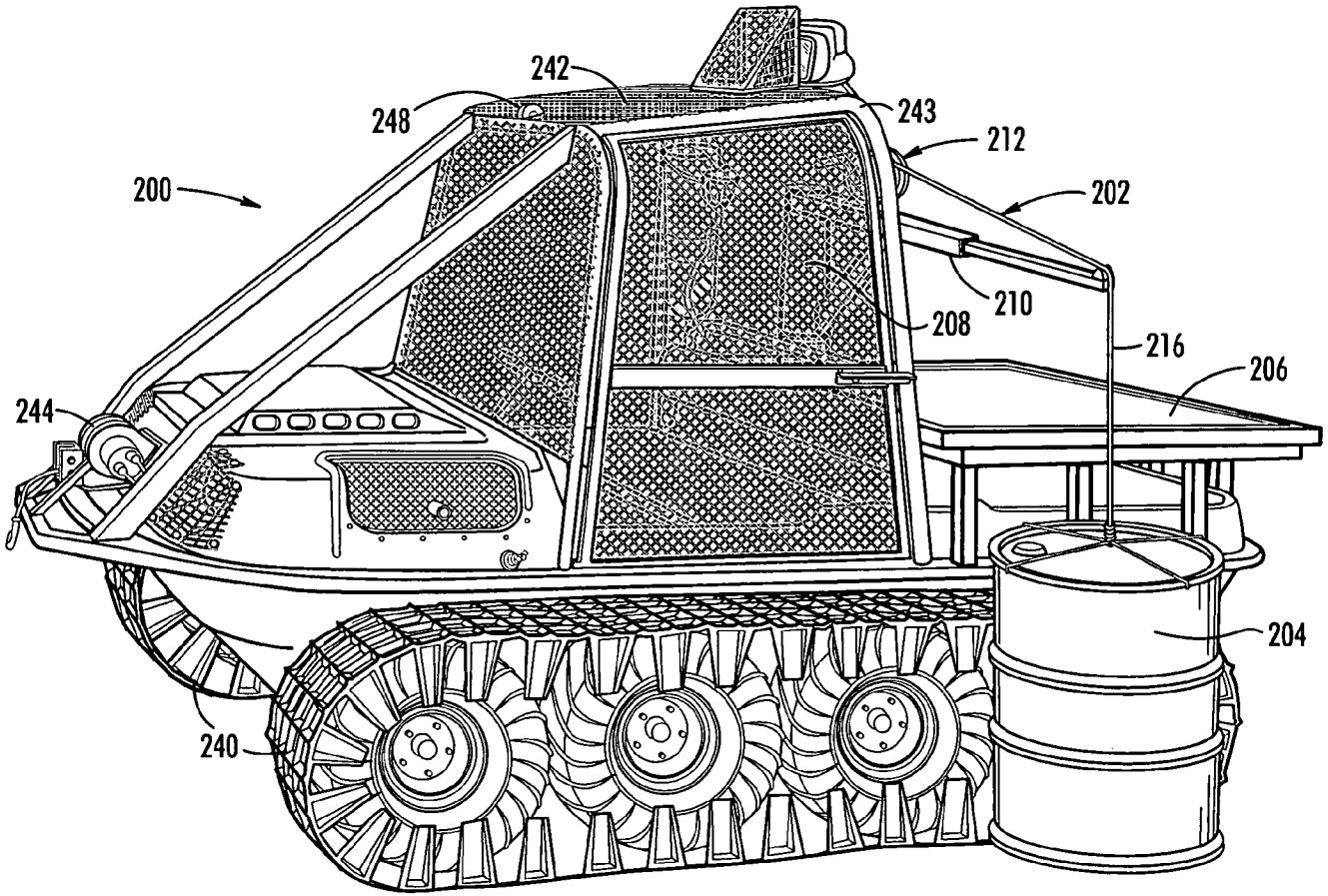
FIG. 1 is a front perspective view of an all terrain vehicle according to an alternative embodiment of the present invention, namely, a vehicle for retrieving hazardous materials.
Figure 2:
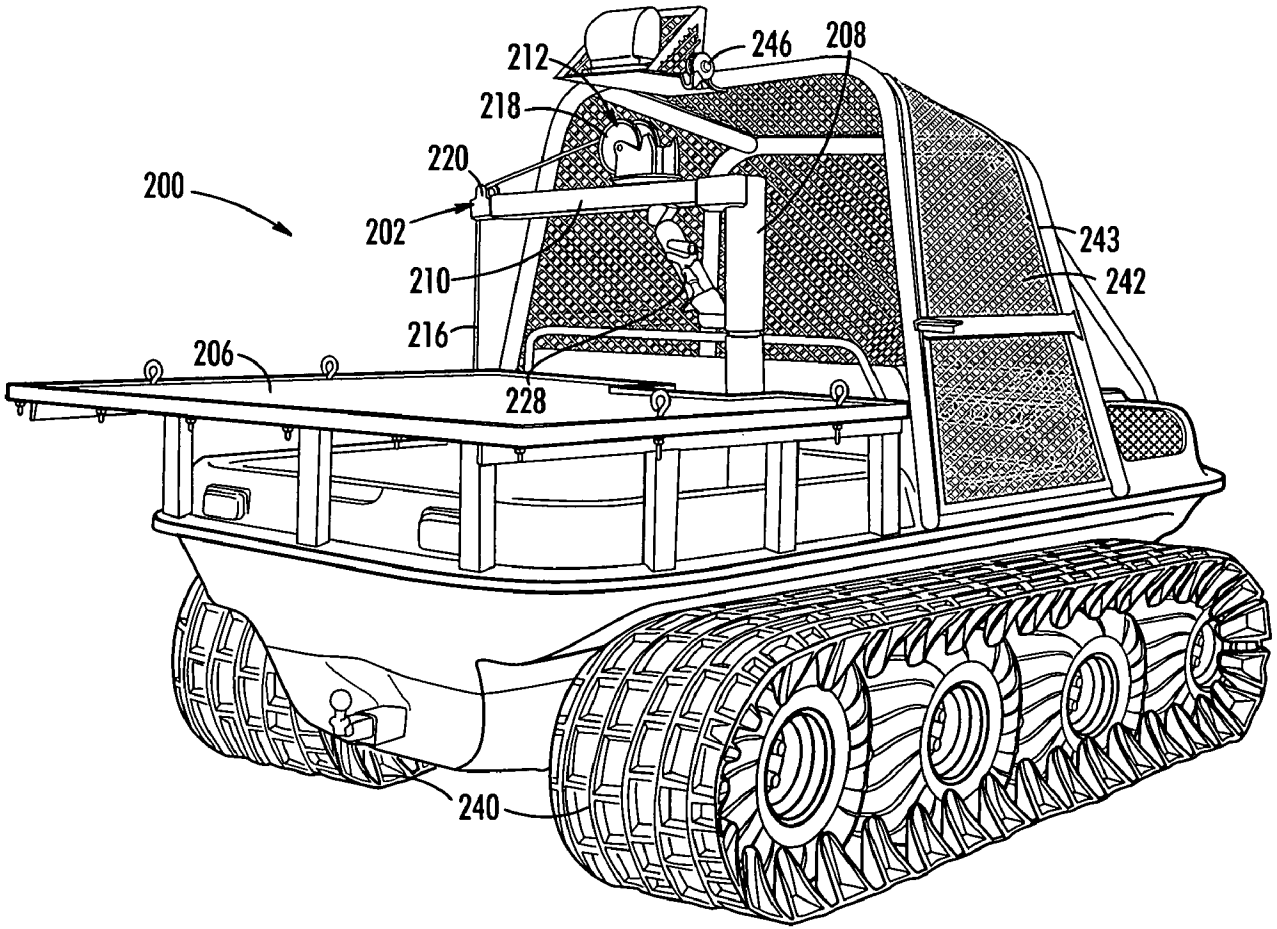
FIG. 2 is a rear perspective view of an all terrain vehicle according to an alternative embodiment of the present invention, namely, a vehicle for retrieving hazardous materials.
Figure 3:
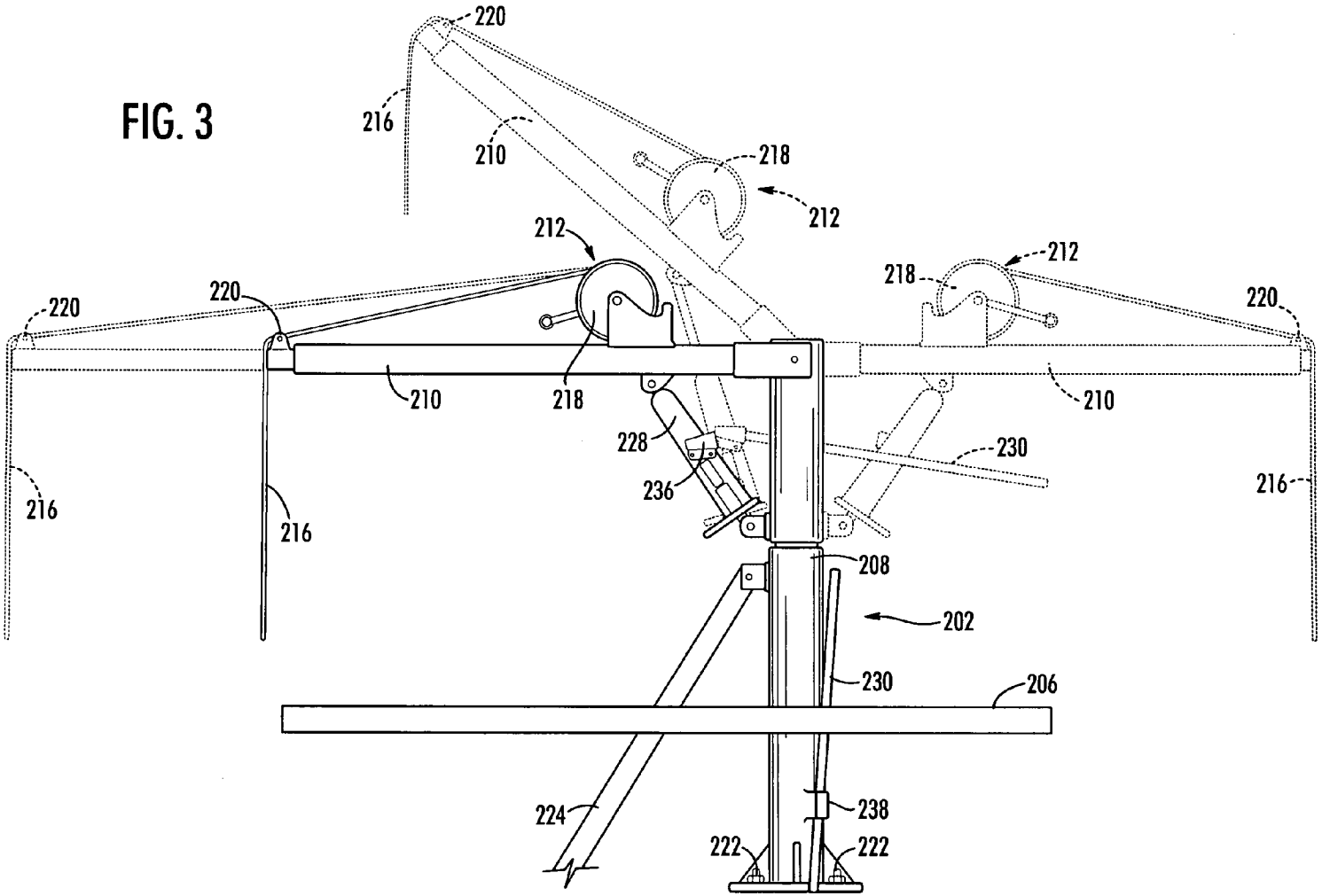
FIG. 3 is a detailed view of the crane shown in FIGS. 1 and 2 of the all terrain vehicle according to a preferred alternative embodiment of the present invention.

Referring now to FIGS. 1-3 in particular, there is illustrated an alternative preferred embodiment of the present invention, an all terrain vehicle for retrieving hazardous materials from remote, rough, overgrown or swampy areas where other vehicles cannot easily go. The vehicle is generally indicated by reference number 200. Vehicle 200 is equipped with a crane 202 for lifting containers 204 onto its deck 206. Crane 202 has a mast 208 and a pivotal arm 210. A cable 220 extends from arm 210 and is controlled by a hand crank 212. Both mast 208 and arm 210 are telescoping so that their reach in the horizontal and vertical directions is greater. A cable 216 runs from a reel 218 to the end of the arm 210 over a pulley 220.

Mast 208 is secured to the floor of vehicle 200 with bolts 222. A brace 224 adds rigidity to mast 208 under load. Arm 210 is pivotal about a pivot pin 226 and is raisable and lowerable with a mechanical jack 228 that is operated by a tool 230 much like a car jack. Tool 230 is inserted in a receptacle 236 and moved up and down to ratchet higher or lower. When jack 228 is ratcheted higher, arm 210 is raised. When ratcheted lower, arm 210 is lowered. Tool 230 is stored in a boot 238 formed on the side of mast 208.

Vehicle 200 is equipped preferably with treads 240 for traction on muddy, swampy soils and a protective mesh 242 on a frame 243 over the driver's area. A winch 244 mounted to the front provides an additional source of pulling power either to the front or, over cab pulley 246, to the rear.

In use, vehicle 200 can be driven to the location of hazardous waste containers, including abandoned waste sites where the ground may be soft from water or chemicals leaking from waste containers and parked close to the waste containers. One by one, each can be lifted using crane 202 to deck 206. Mast 208 and arm 210 are extended as required and pinned using pins 214. Arm 210 is raised as required using jack 228. Then cable 216 is attached to container 204 and hand crank 212 is turned to lift container 204 higher than the surface of deck 206. Arm 210 is rotated over deck 206 and container 204 is lowered and secured.

Figure 4:
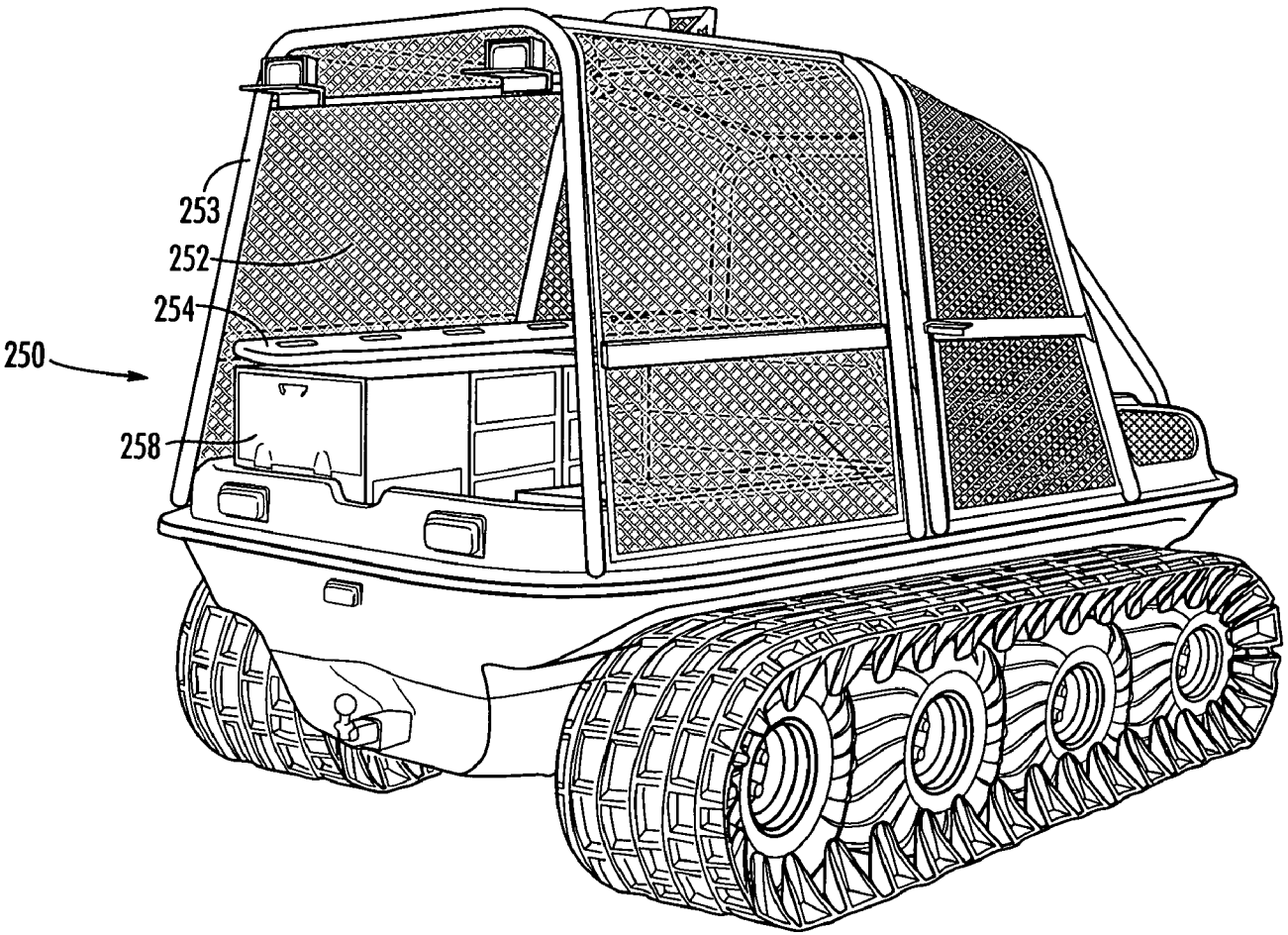
FIG. 4 is a rear perspective view of an all terrain vehicle according to an alternative embodiment of the present invention, namely, a vehicle for emergency medical services or rescue services.
Figure 5:
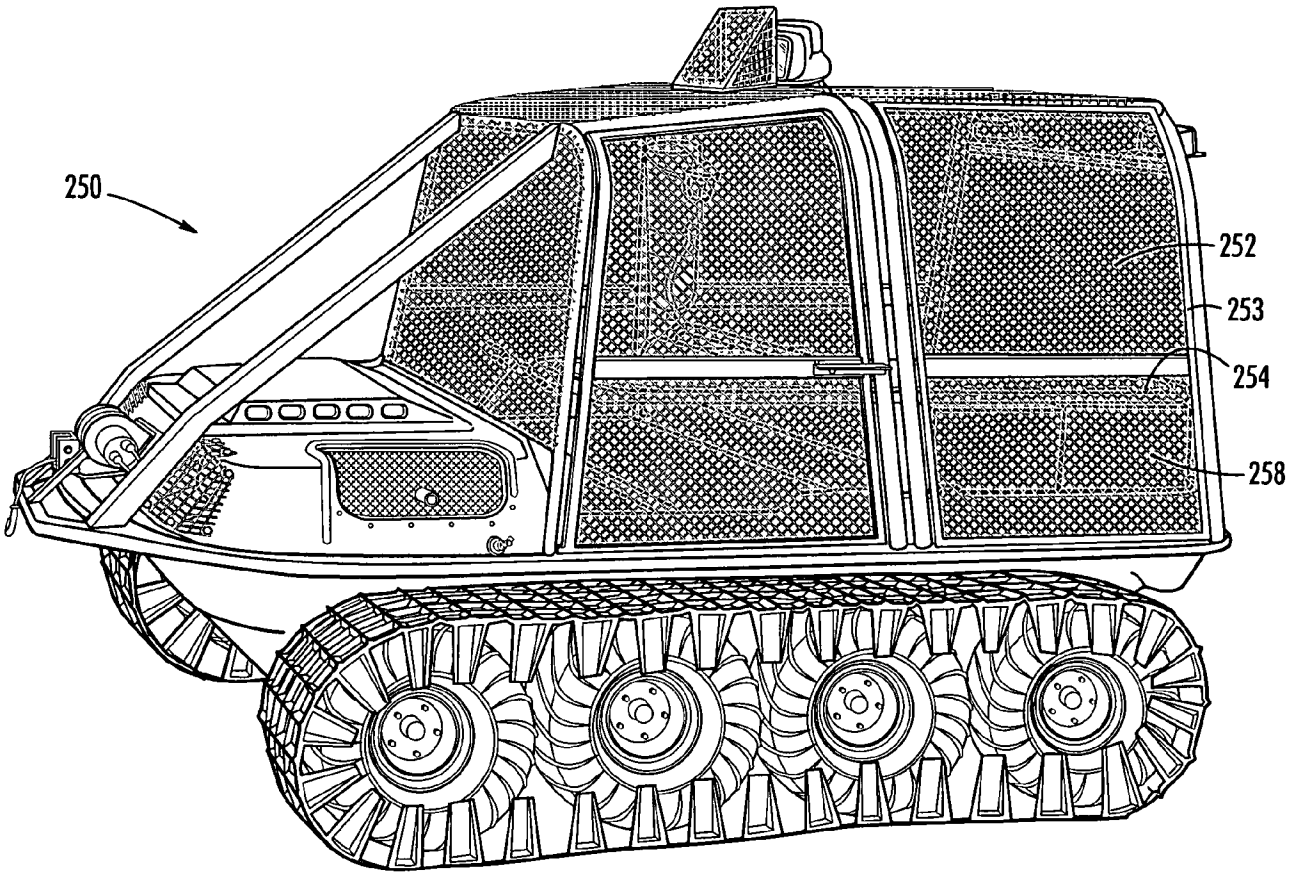
FIG. 5 is a front perspective view of an all terrain vehicle according to an alternative embodiment of the vehicle of FIG. 4.

FIGS. 4 and 5 illustrate the basic configuration for two other embodiments of the present invention, the search and rescue all terrain vehicle and the emergency medical all terrain vehicle. Clearly, both vehicles are designed to go across rough terrain for particular purposes and are equipped for those particular purposes. Rather than for hunting and fishing, however, the present embodiments are equipped to render assistance to individuals who may be lost or trapped and who may be in need of medical assistance. In either case, the present vehicle 250 is equipped with a protective mesh 252 on a frame 253 that extends over the cab, occupied by the driver, to the rear area of the vehicle, and a stretcher 254 that is elevated so that it extends over the back of the front seat and partially into the cab. Preferably, the elevation of the stretcher is achieved by cabinetry 258 for storage of useful supplies and equipment below the stretcher.

Figure 6:
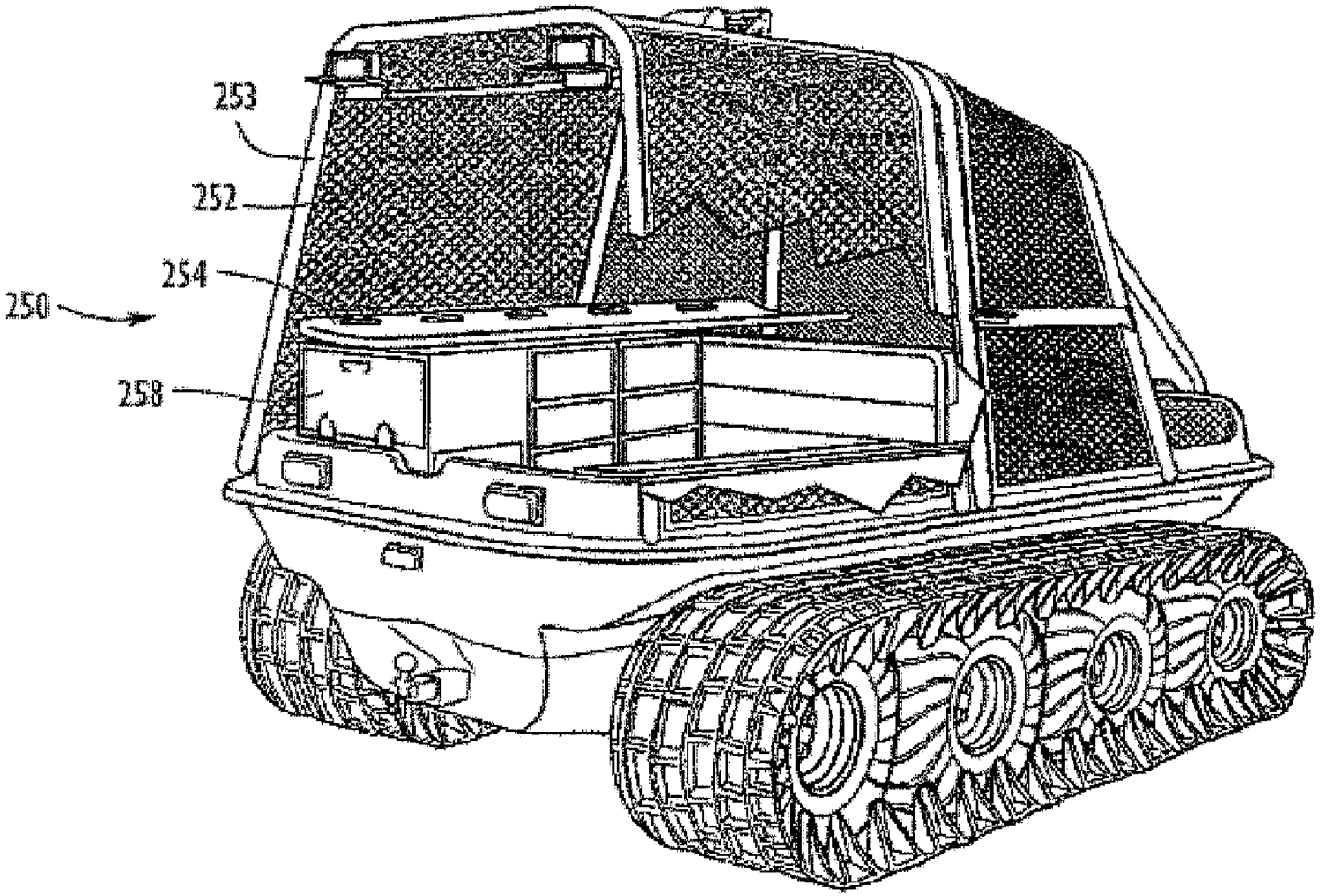
FIG. 6 is a view of the vehicle of FIGS. 4 and 5, the view being similar to FIG. 4 with a portion of the wired mesh removed to better view the interior contents of the depicted vehicle.

Referring now to FIG. 6, there is shown another view of the search and rescue terrain and emergency medical all terrain vehicle. FIG. 6 further shows the interior of the rear area of the vehicle with a stretcher 254 that is elevated so that it extends over the back of the front seat and partially into the cab. In this embodiment, the elevation of the stretcher is achieved by cabinetry 258 for storage of useful supplies and equipment below the stretcher.

In additional to storage of supplies, medical or search and rescue equipment should accompany vehicle 250 that would be needed or helpful in a search and rescue operation. For example, vehicle 250 can carry ropes, chains, a backboard, blankets, shovels, a tripod (used for confined space rescues, safety harnesses and other climbing or descending equipment, hardhats, flashlights, flares, etc. When vehicle 250 is used for emergency medical purposes, it would preferably have most or all of the equipment carried by an over-the-road EMS vehicle, such as a backboard, oxygen, a jump kit, automatic defibrillators, intravenous hooks, etc.

Most of these supplies can be stored in cabinetry 258 or deployed about the interior of vehicle 250 where convenient.

It will be apparent to those skilled in the art of retrieving hazardous materials, of performing rescues, and of providing emergency medical services to those requiring it in remote areas that many modifications and substitutions can be made to the preferred embodiments described above without departing from the spirit and scope of the present invention.

What is claimed is:

1. An apparatus, comprising:

an all terrain vehicle having a cab with a front seat and a rear area, said front seat being located in a front seat area of said cab;

cabinetry carried by said all terrain vehicle in said rear area, said cabinetry having a top surface level with said front seat;

a frame carried by said all terrain vehicle wherein a metal mesh is carried by said frame, said frame and said mesh being positioned to protect occupants of said all terrain vehicle who are located in said front seat and in said rear area from external objects that approach said vehicle from each of a front direction and at least one side direction as said vehicle moves across terrain; and said all terrain vehicle being drivable across terrains that include at least uneven ground, mud, deep water, heavy swamps, and slippery ground.

2. The apparatus as recited in claim 1, further comprising a stretcher and wherein said cabinetry is dimensioned to hold a major portion of said stretcher, said stretcher being contained and protected from external objects that approach said vehicle from each of a front direction and at least one side direction by said frame and said metal mesh.

3. The apparatus as recited in claim 1, further comprising a stretcher, wherein said cabinetry is dimensioned to hold a major portion of said stretcher, said stretcher being contained and protected from external objects that approach said vehicle from each of a front direction and at least one side direction by said frame and said metal mesh, said stretcher, when held by said cabinetry, extending into said front seat area of said cab.

4. The apparatus as recited in claim 1, wherein said metal mesh covers said cab including at least a portion of said rear area.

5. The apparatus as recited in claim 1, said metal mesh covering said cab including at least a portion of said rear area, said apparatus further comprising a stretcher, said stretcher being positioned to extend part way into said front seat area of said cab, said stretcher being contained and protected from external objects that approach said vehicle from each of a front direction and at least one side direction by said frame and said metal mesh.

6. An apparatus, comprising:

an all terrain vehicle having a cab with a front seat and a rear area, said front seat being located in a front seat area of said cab;

a stretcher carried by said all terrain vehicle;

a frame carried by said all terrain vehicle wherein a metal mesh is carried by said frame, said frame and said mesh being positioned to protect occupants of said all terrain vehicle who are located in said front seat and in said rear area from external objects that approach said vehicle from each of a front direction and at least one side direction as said vehicle moves across terrain; and cabinetry carried by said all terrain vehicle in said rear area, said cabinetry having a top surface level with said front seat and adapted to support at least a portion of said stretcher, said stretcher being contained and protected from external objects that approach said vehicle from each of a front direction and at least one side direction by said frame and said metal mesh;

said all terrain vehicle being drivable across terrains that include at least uneven ground, mud, deep water, heavy swamps, and slippery ground.

7. An apparatus, comprising:

an all terrain vehicle having a cab with a front seat and a rear area, said front seat being located in a front seat area of said cab;

a stretcher carried by said all terrain vehicle;

a frame carried by said all terrain vehicle wherein a metal mesh is carried by said frame, said frame and said mesh being positioned to protect occupants of said all terrain vehicle who are located in said front seat and in said rear area from external objects that approach said vehicle from each of a front direction and at least one side direction as said vehicle moves across terrain; and comprising cabinetry carried by said all terrain vehicle in said rear area, said cabinetry having a top surface level with said front seat and adapted to support at least a portion of said stretcher, said stretcher being contained and protected from external objects that approach said vehicle from each of a front direction and at least one side direction by said frame and said metal mesh, said metal mesh covering said cab including said rear area;

said all terrain vehicle being drivable across terrains that include at least uneven ground, mud, deep water, heavy swamps, and slippery round.

* * * * *